US005153361A

United States Patent [19]

Kozuki

[11] Patent Number: 5,153,361

[45] Date of Patent: Oct. 6, 1992

[54] AUTOMATIC KEY DESIGNATING APPARATUS

[75] Inventor: Koichi Kozuki, Hamamatsu, Japan

[73] Assignee: Yamaha Corporation, Hamamatsu, Japan

[21] Appl. No.: 410,724

[22] Filed: Sep. 21, 1989

[30] Foreign Application Priority Data

Sep. 21, 1988 [JP] Japan ..... 63-236834

[51] Int. Cl.[5] ..... G10H 7/00; G10H 1/38

[52] U.S. Cl. ..... 84/613; 84/637

[58] Field of Search ..... 84/610, 637, 650, 666, 84/669, 613, DIG. 22, 609, 616, 619, 649, 654, 657

[56] References Cited

U.S. PATENT DOCUMENTS

| | | | |
|---|---|---|---|
| 4,419,916 | 12/1983 | Aoki | 84/1.01 |
| 4,656,911 | 4/1987 | Sakurai | 84/613 X |
| 4,896,576 | 1/1990 | Ino | 84/634 |
| 5,003,860 | 4/1991 | Minamitaka | 84/609 |

*Primary Examiner*—William M. Shoop, Jr.
*Assistant Examiner*—Jeffrey W. Donels
*Attorney, Agent, or Firm*—Spensley Horn, Jubas & Lubitz

[57] ABSTRACT

An automatic key designating apparatus is used for an electronic musical instrument in order to automatically designating a desirable key in response to a chord progression consisting of several chords designated by a performer during a performance. This apparatus provides a chord designating unit (preferably, a keyboard) capable of sequentially designating chords and a memory capable of storing chord information concerning at least a current chord, a preceding chord and a previous chord which were sequentially designated. When it is detected that a predetermined specific chord progression is established in these three chords, key data corresponding to such chord progression is set. Based on this key data, a desirable key is automatically designated. Meanwhile, before setting the key data indicative of the finally determined key, a temporary key can be determined based on the previous and preceding chords. If it is judged that the current chord is on the scale concerning the temporary key, this temporary key is set as the key data. If not, the temporary key is replaced by a new key based on the three chords, which is to be set as the key data.

6 Claims, 12 Drawing Sheets

71a:CHORD DETECTING TABLE

| NOTE NAME / CHORD TYPE | B 11 | A# 10 | A 9 | G# 8 | G 7 | F# 6 | F 5 | E 4 | D# 3 | D 2 | C# 1 | C 0 |
|---|---|---|---|---|---|---|---|---|---|---|---|---|
| M | | | | | 1 | | | 1 | | | | 1 |
| M7 | 1 | | | | 1 | | | 1 | | | | 1 |
| M7 | 1 | | | | | | | 1 | | | | 1 |
| 6th | | | 1 | | 1 | | | 1 | | | | 1 |
| m | | | | | 1 | | | | 1 | | | 1 |
| m7 | 1 | | | | 1 | | | | 1 | | | 1 |
| m7 | 1 | | | | | | | | 1 | | | 1 |
| 7th | 1 | | | | 1 | | | 1 | | | | 1 |
| 7th | 1 | | | | | | | 1 | | | | 1 |
| 7sus4 | 1 | | | | 1 | | 1 | | | | | 1 |
| M7-5 | 1 | | | | | 1 | | | 1 | | | 1 |

FIG.2A

71a:CHORD GROUP TABLE

| ADDRESS | TGCNV | CHORD TYPE |
|---|---|---|
| 0 | 0 | M |
| 1 | 0 | $M_7$ |
| 2 | 0 | 6th |
| 3 | 1 | m |
| 4 | 1 | $m_7$ |
| 5 | 2 | 7th |
| 6 | 2 | $7sus_4$ |
| 7 | 3 | $m_7{}^{-5}$ |

FIG.2B

71d:SCALE CHORD DETECTING TABLE

| ADDRESS | TBLDEG | | | | CHORD ON SCALE |
|---|---|---|---|---|---|
| | $G_3$ | $G_2$ | $G_1$ | $G_0$ | |
| 0 | | | | 1 | $I_M, I_{M7}, I_{6th}$ |
| 1 | | | | | |
| 2 | | | 1 | | $II_m, II_{m7}$ |
| 3 | | | | | |
| 4 | | 1 | 1 | | $III_m, III_{m7}, III_{7th}, III_{7sus4}$ |
| 5 | | | | 1 | $IV_M, IV_{M7}, IV_{6th}$ |
| 6 | | | | | |
| 7 | | 1 | | | $V_{7th}, V_{7sus4}$ |
| 8 | | | | | |
| 9 | | | 1 | | $VI_m, VI_{m7}$ |
| 10 | | | | | |
| 11 | 1 | | | | $VII_{m7}{}^{-5}$ |

FIG.2D

71c:NORMAL CHORD PERCUSSION DETECTING TABLE

| ADDRESS | TBLDLT | TBLGP3 | | | | | TBLGP2 | | | | | TBLKEY |
|---|---|---|---|---|---|---|---|---|---|---|---|---|
| | | M | $G_3$ | $G_2$ | $G_1$ | $G_0$ | M | $G_3$ | $G_2$ | $G_1$ | $G_0$ | |
| 0 | 5 | | | 1 | | | | | | | 1 | 5 |
| 1 | 2 | | | 1 | | | | | | 1 | | 5 |
| 2 | 9 | | | 1 | | | | | 1 | 1 | | 5 |
| 3 | 10 | | | 1 | | | | | | | 1 | 5 |
| 4 | 5 | | | | 1 | | 1 | | 1 | | | 10 |
| 5 | 2 | | | | 1 | | 1 | | 1 | 1 | | 10 |
| 6 | 9 | | | | 1 | | | 1 | | | | 10 |
| 7 | 2 | | | | | 1 | 1 | | 1 | | | 7 |
| 8 | 11 | | | | | 1 | 1 | | 1 | 1 | | 7 |
| 9 | 6 | | | | | 1 | | 1 | | | | 7 |
| 10 | 5 | 1 | | 1 | | | | | 1 | | | 8 |
| 11 | 10 | 1 | | 1 | | | | | 1 | | | 8 |
| 12 | 1 | 1 | | 1 | | | | | | | 1 | 8 |
| 13 | 7 | 1 | | 1 | | | | 1 | | | | 8 |
| 14 | 3 | 1 | | 1 | | | | | 1 | | | 8 |
| 15 | 5 | | 1 | | | | 1 | | 1 | 1 | | 1 |
| 16 | 6 | | 1 | | | | | | | | 1 | 1 |
| 17 | 3 | | 1 | | | | | | | 1 | | 1 |
| 18 | 10 | | 1 | | | | | | | 1 | | 1 |

FIG.2C

74: KEY CONVERSION TABLE

| KEY \ PITCH | C | C# | . | . | . | . | B |
|---|---|---|---|---|---|---|---|
| C KEY | 0 | +1 | . | . | . | . | 0 |
| C#KEY | 0 | 0 | . | . | . | . | +1 |
| . | . | . | . | . | . | . | . |
| . | . | . | . | . | . | . | . |
| . | . | . | . | . | . | . | . |
| . | . | . | . | . | . | . | . |
| B KEY | +1 | 0 | . | . | . | . | 0 |
| NON-DECIDED | 0 | 0 | 0 | 0 | 0 | 0 | 0 |

FIG.3C

AUTOMATIC KEY DESIGNATING APPARATUS

BACKGROUND OF THE INVENTION

1. Field of the Invention

The present invention relates to an automatic key designating apparatus which is used for an electronic musical instrument.

2. Prior Art

In accordance with the progress in the automatic control technique of the electronic musical instrument, several kinds of automatic accompaniment apparatuses have been developed in these years. This automatic accompaniment apparatus is designed to automatically form additional tones such as duet tones, arpeggio tones, bass tones etc. based on melody performance, chord performance and the like. Then, these additional tones are automatically sounded with chord performance tones and melody performance tones. In this case, it is possible to form the additional tone based on the single chord only. However, in order to form the additional tones suitable for the tune, i.e., suitable for the chord progression, it is desirable to detect the key of the tune to be performed.

Based on such demand, Japanese Patent Laid-Open Publication (i.e., Kokai) No. 57-136696 (corresponding to U.S. Pat. No. 4,419,916) discloses the electronic musical instrument capable of designating the key based on the operations of key designating switches and keys of keyboard prior to the performance (hereinafter, in order to avoid the confusion between "key" and "keys of keyboard", "keys of keyboard" is denoted to as "keyboard-keys"). For example, by simultaneously operating the key designating switch and keyboard keys corresponding to the C tone, it is possible to designate the C key.

However, this conventional apparatus is disadvantageous in that the performer must operate such switch and keyboard-keys to thereby designate the key by himself. Such operation is troublesome for the performer. In addition, in the case where the performer does not know the key of the tune to be performed, it is impossible to designate the key with ease. Further, since such key designation is made by use of the keyboard-keys, it is impossible to designate the key in the middle of the performance. In other words, it is impossible to effect the modulation in the middle of the performance.

SUMMARY OF THE INVENTION

It is accordingly a primary object of the present invention to provide an automatic key designating apparatus capable of automatically designating the key of the tune to be performed based on the chord performance information.

In a first aspect of the present invention, there is provided an automatic key designating apparatus comprising:

(a) chord designating means for sequentially designating chords;

(b) memory means for storing at least first to third chord informations respectively indicating a current chord, a preceding chord and a previous chord which are sequentially designated by the chord designating means in time-series manner;

(c) detecting means for detecting a predetermined specific chord progression concerning continuous three chords based on the chord informations stored in the memory means; and (d) means for setting key data corresponding to the specific chord progression detected by the detecting means, whereby a desirable key is automatically designated based on the key data.

In a second aspect of the present invention, there is provided an automatic key designating apparatus comprising:

(a) chord designating mean for sequentially designating chords;

(b) memory means for storing at least first to third chord informations respectively indicating a current chord, a preceding chord and a previous chord which are sequentially designated by the chord designating means in time-series manner;

(c) detecting means for detecting a predetermined specific chord progression corresponding to the previous chord and the preceding chord based on the third chord information concerning the previous chord and the second chord information concerning the preceding chord;

(d) first means for determining a temporary key corresponding to the specific chord progression detected by the detecting means;

(e) judging means for judging whether or not the current chord is on a scale concerning the temporary key based on the first chord information concerning the current chord; and (f) second means for setting the temporary key as a desirable key to be finally determined when the judging means judges that the current chord is on the scale concerning the temporary key, the second means generating key data indicative of the temporary key, whereby the desirable key is automatically designated based on the key data.

In a third aspect of the present invention, there is provided an automatic key designating apparatus comprising:

(a) chord designating means for sequentially designating chords;

(b) key determining means for determining a key in response to a chord progression of the chords designated by the chord designating means;

(c) memory means for storing key data indicative of a determined key;

(d) judging means for judging whether or not at least one new chord designated by the chord designating means is on a scale concerning the determined key stored in the memory means; and (e) key data control means for remaining the key data as it is when the judging means judges that the at least one new chord is on the scale, while the key data control means replacing the key data with new key data when the judging mean judges that the at least one new chord is not on the scale, whereby a desirable key is automatically designated based on the key data to be controlled by the key data control means.

BRIEF DESCRIPTION OF THE DRAWINGS

Further objects and advantages of the present invention will be apparent from the following description, reference being had to the accompanying drawings wherein a preferred embodiment of the present invention is clearly shown.

In the drawings:

FIGS. 2A to 2D show detailed contents of several kinds of detection tables illustrated in FIG. 1;

FIG. 3C shows a detailed configuration of a key conversion table illustrated in FIG. 1

DESCRIPTION OF A PREFERRED EMBODIMENT

[A]CONFIGURATION OF ELECTRONIC MUSICAL INSTRUMENT

Figure 1:
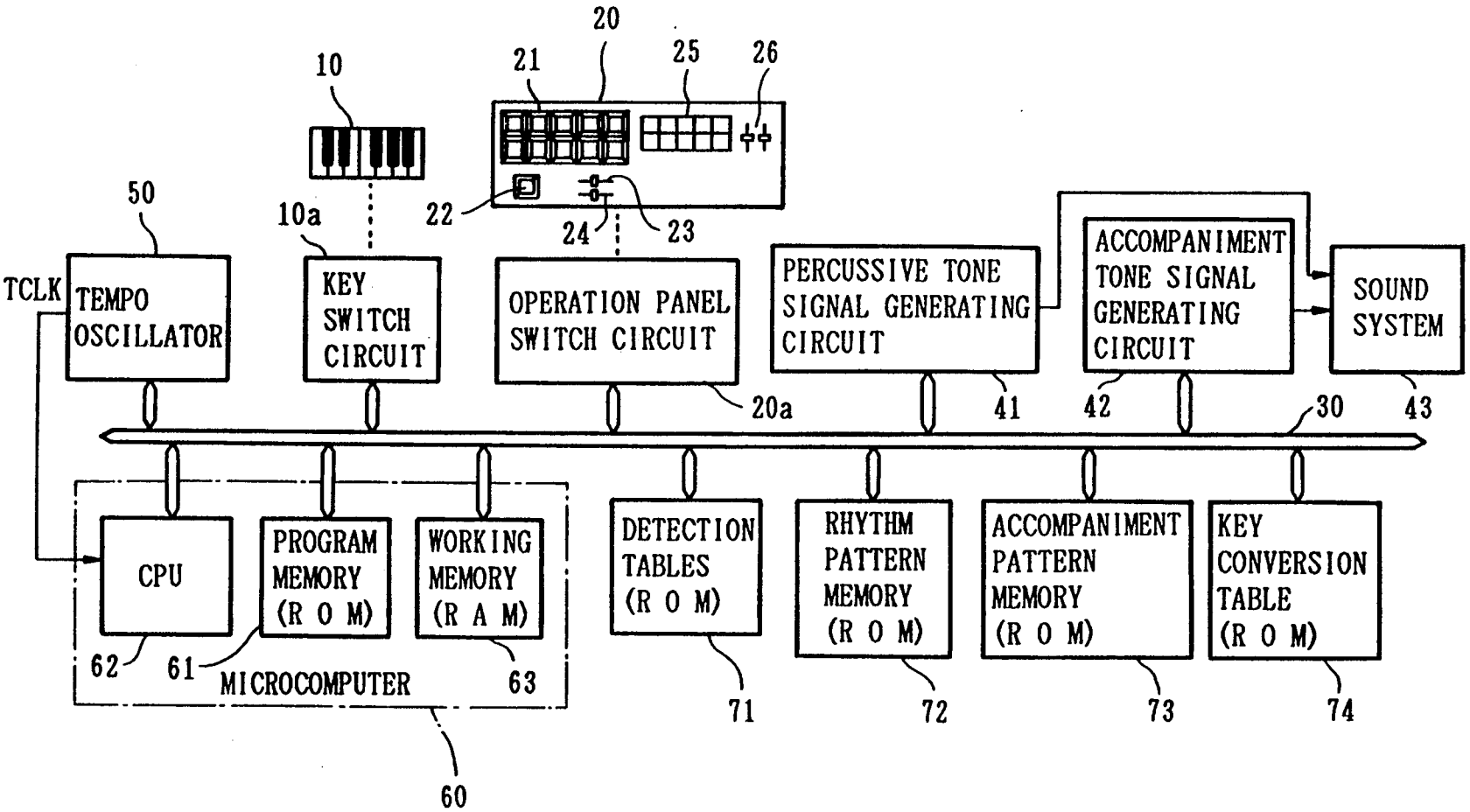
FIG. 1 is a block diagram showing the whole configuration of the electronic musical instrument employing the automatic key designating apparatus according to an embodiment of the present invention.

Referring now to the drawings, wherein like reference characters designate like or corresponding parts throughout the several views, FIG. 1 is a block diagram showing the whole configuration of the electronic musical instrument employing the automatic key designating apparatus according to an embodiment of the present invention The electronic musical instrument as illustrated in FIG. 1 provides a keyboard 10 and an operation panel 20. The keyboard 10 includes plural keyboard-keys for designating the chords, and a key switch circuit 10*a* includes plural key switches each corresponding to each keyboard-key. The key-depression and key-release of each keyboard-key is detected by on/off states of the corresponding key switch. The plural keyboard-keys correspond to Cl to C7 tones, and each keyboard-key is assigned with a key code KC whose value ranges from "24" to "96". The key switch circuit 10*a* includes a chattering preventing circuit, a wait timer circuit etc., by which the mistaken operation of touching the keyboard-key (hereinafter, referred simply to as a mistouch) is excluded. In addition, the key-depressions of plural keyboard-keys which are depressed at slightly different timings can be detected as the simultaneous key-depressions, all of which are then detected as one key-depression event.

The operation panel 20 provides rhythm selecting switches 21 for selecting desirable one of plural rhythm kinds such as the march, waltz etc.; a start/stop switch 22 for controlling the start and stop of the rhythm and automatic performance; a tempo control 23 for controlling the tempo of the rhythm and automatic performance; a rhythm tone volume control 24 for controlling the tone volume of the rhythm tone; an accompaniment tone color selecting switches 25 for selecting the desirable tone color of the accompaniment tone; and accompaniment tone volume controls 26 for controlling the tone volume of the accompaniment tone. The operations of these switches and controls are respectively detected by the corresponding circuits (not shown) within an operation panel switch circuit 20*a*.

These switch circuits 10*a*, 20*a* are both connected to a bus 30, to which a percussive tone signal generating circuit 41, an accompaniment tone signal generating circuit 42, a tempo oscillator 50 and a microcomputer 60 are further connected.

The percussive tone signal generating circuit 41 provides plural percussive tone channels each capable of generating a percussive tone signal corresponding to each of percussion instruments such as a cymbal, bass drum etc. Each percussive tone channel generates and outputs the percussive tone signal in response to rhythm pattern data RPDT (such as RPDTI, RPDT2, RPDT3, ...) which is supplied from the microcomputer 60 via the bus 30. The rhythm pattern data RPDTl, RPDT2, ... correspond to respective kinds of the percussion instruments. The accompaniment tone signal generating circuit 42 provides plural (i.e., n, which denotes to an arbitrary integral number) musical tone channels each capable of generating each of the musical tone signals corresponding to the musical instruments such as a piano, violin, etc. In response to tone color data, tone pitch data, key-on signal KON and key-off signal KOF which are supplied from the microcomputer 60 via the bus 30, each musical tone channel generates and outputs the musical tone signal having the tone color corresponding to the tone color data and the tone pitch corresponding to the tone pitch data. These circuits 41, 42 are connected to a sound system 43 which includes an amplifier, speaker etc. therein. Thus, this sound system 43 sounds the musical tone corresponding to the signals supplied from the circuits 41, 42.

The tempo oscillator 50 generates and outputs a tempo clock interrupt signal TCLK having the frequency corresponding to the thirty-second note (i.e., demisemiquaver). In other words, four clocks of this TCLK correspond to a quarter note. This tempo clock interrupt signal TCLK is fed to the microcomputer 60. The frequency of this signal TCLK is determined by tempo data supplied from the microcomputer 60 via the bus 30.

The microcomputer 60 consists of a program memory 61, a central processing unit (CPU) 62 and a working memory 63, all of which are connected to the bus 30. The program memory 61 is constructed by a read-only memory (ROM), which stores the main program and its subprograms, clock interrupt program corresponding to the flowcharts as shown in FIGS. 4 to 9. The CPU 62 starts the execution of the main program when a power switch (not shown) is on. The execution of this main program is repeated until the power switch is off. At the arrival of the tempo clock interrupt signal TCLK from the tempo oscillator 50, the CPU 62 breaks the execution of the main program and then starts the execution of the clock interrupt program. The working memory 63 is constructed by a random-access memory (RAM), which temporarily stores several kinds of data necessary to execute the above-mentioned programs.

Further, several kinds of detection tables 71, a rhythm pattern memory 72, an accompaniment pattern memory 73 and a key conversion table 74 are connected to the bus 30. The detection tables 71 are constructed by the ROMs, which provides a chord detecting table 71*a*, a chord group table 71*b*, a normal chord progression detecting table 71*c* and a scale chord detecting table 71*d*.

The chord detecting table 71*a*, as shown in FIG. 2A, is provided for detecting the chord based on key information corresponding to the key-depressions of the keyboard 10. By every eight kinds of chord types (i.e., M, $M_7$, 6th, m, $m_7$, 7th, 7SUS4, $m_7{}^{-5}$) which can be detected by the present electronic musical instrument, the chord detecting table 71*a* stores basic constituent note pattern data of each chord type based on the C tone which is set as the chord root. In this table 71*a* shown in FIG. 2A, "1" designates the existence of the chord constituent note, while the blank designates the non-existence of the chord constituent note.

Next, description will be given with respect to the expressions of the chord types which are used in the present embodiment. Herein, the characters in the parenthesis "[ ]" designate the chord type whose root is the C tone.

| | |
|---|---|
| Major | M [$C_M$] |
| Major Seven | $M_7$ [$C_{M7}$] |
| Major Sixth | 6th [$C_{6th}$] |
| Minor | m [Cm] |
| Minor Seventh | $m_7$ [$Cm_7$] |
| Dominant Seventh | 7th [$C_{7th}$] |
| Seventh Suspended 4 | 7SUS4 [$C_{7SUS4}$] |
| Minor Seven Flat Five | $m_7{}^{-5}$ [$Cm_7{}^{-5}$] |

Incidentally, these chord types M, $M_7$, 6th, m, $m_7$, 7th, 7SUS4, $m_7{}^{-5}$ are respectively assigned to chord codes "0"to "7".

The chord group table 71*b*, as shown in FIG. 2B, is provided for classifying the above-mentioned eight chord types into four chord groups (i.e., major group, minor group, seventh group and minor seven flat five group). By using the chord codes "0" to "7" as the addresses, chord group codes "0" to "3" are stored by each chord type.

The normal chord progression detecting table 71*c*, as shown in FIG. 2*c*, can detect nineteen kinds of specific chord progressions based on the preceding chord and the chord just before this preceding chord (hereinafter, referred to as a previous chord). Then, based on the detection results of this table 71*c*, a temporary chord is to be determined. By using the nineteen kinds of specific chord progressions as addresses "0" to "18", this table 71*c* stores pitch difference data TBLDLT, chord group data TBLGP3, TBLGP2 and key determinating data TBLKEY. The pitch difference data TBLDLT designates a condition of the chord root, and it designates the pitch difference between the roots of the preceding chord and previous chord, wherein this pitch difference is expressed by the number of semitones. The chord group data TBLGP3, TBLGP2 designate a condition of the chord type in the specific chord progression described above, wherein TBLGP2 corresponds to the preceding chord and TBLGP3 corresponds to the previous chord. In the chord group data TBLGP3, TBLGP2, the lower four bits (i.e., rightmost four bits) GO to G3 respectively correspond to the chord group codes "0" to "3". More specifically, when "1" is assigned to any one of these bits GO to G3, it is designated that the corresponding chord group relates to the preceding or previous chord. In addition, when "1" is at the most significant bit (MSB) M in TBLGP2 or TBLGP3, the preceding or previous chord belongs to the major chord type. Incidentally, in the table 71*c*, "0" is to be placed at the blanks (not shown). The key determining data TBLKEY designates the pitch difference between the note name of the temporary chord and the root of the previous chord, wherein this pitch difference is expressed by the number of semitones.

The scale chord detecting table 71*d*, as shown in FIG. 2D, is provided for detecting the chord on the scale relating to each key. At each of addresses "0" to "11" of this table 71*d*, the chord group data TBLDEG is stored. This address corresponds to the pitch difference between the base note (e.g., C tone in case of the C key) and the chord root, wherein this pitch difference is expressed by the number of semitones. The chord group data TBLDEG consists of four bits GO to G3 which respectively correspond to the chord groups "0" to "3" on the scale. The existence of each chord group is designated by setting "1" at each bit. In the scale chord detecting table 71*d*, "0" (not shown) is set at the blanks of the bits.

Figure 3A:
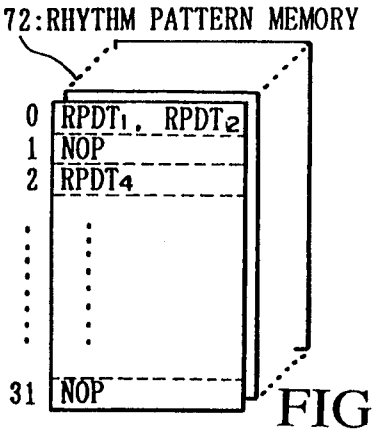
FIG. 3A shows a detailed configuration of a rhythm pattern memory illustrated in FIG. 1.

The rhythm pattern memory 72, as shown in FIG. 3A, is divided into plural pattern memories each corresponding to each of the rhythm kinds. Each pattern memory provides thirty-two addresses (corresponding to one musical bar) which are designated by the tempo count data CLK (0 to 31). At each address, one or more rhythm pattern data RPDTl, RPDT2, ... to be sounded are stored. In addition, data "NOP" indicative of the non-sound-processing is stored at the addresses where the percussive tones are not to be sounded.

Figure 3B:
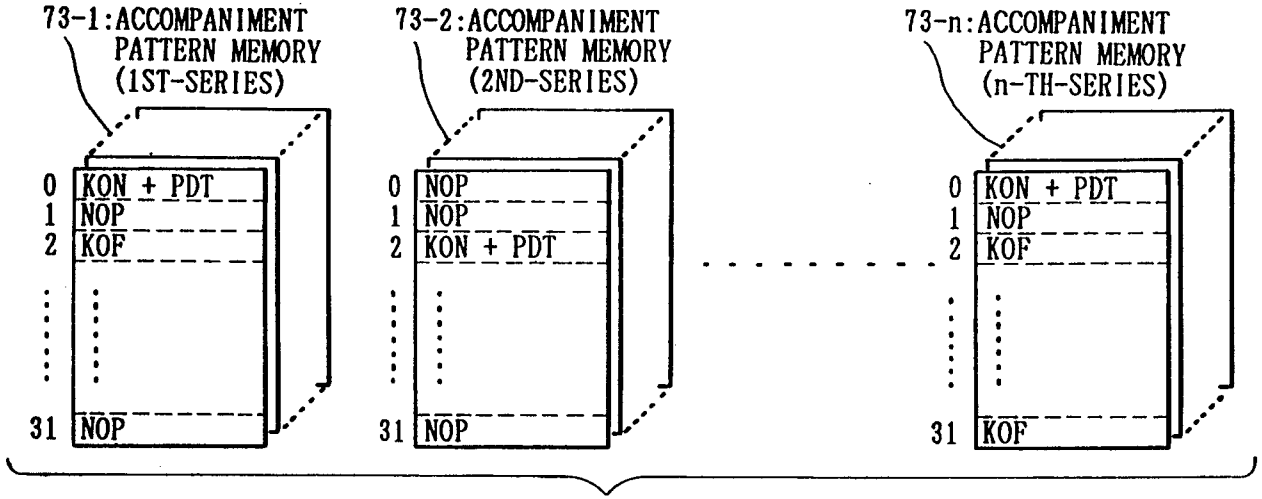
FIG. 3B shows detailed configurations of an accompaniment pattern memory illustrated in FIG. 1.

The accompaniment pattern memory 73, as shown in FIG. 3B, provides plural series of accompaniment pattern memories 73-1, 73-2, ..., 73-n each corresponding to each of plural accompaniment tones such as the arpeggio tones, bass tones and the like. Each series of accompaniment pattern memory is further divided into plural pattern memories corresponding to the rhythm kinds and chord types. Each pattern memory provides thirty-two addresses which are designated by the tempo count data CLK (0 to 31). At each address, the data such as the key-on data KON, interval data PDT and key-off data KOF are stored, wherein KON indicates the sound-start-timing (i.e., key-on timing) of each accompaniment tone, PDT used for determining the tone pitch of each accompaniment tone is expressed by the number of semitones from the chord root, and KOF indicates the sound-end-timing (i.e., key-off timing). At the addresses which do not correspond to the key-on or key-off timing, the data "NOP" is stored.

The key conversion table 74, as shown in FIG. 3C, is provided for converting the note name which is not included in the scale into another note name which is included in the scale. This table 74 stores the increment value for such key conversion by each pitch data PITCH and each key data KEY. In the case where the key is not determined, "0" is stored as the increment value.

[B]OPERATION OF ELECTRONIC MUSICAL INSTRUMENT

Next, description will be given with respect to the operation of the electronic musical instrument whose configuration is as described above. First, description will be given with respect to the diagrammatical operation of the present electronic musical instrument by referring to FIGS. 4 and 5.

(1) Diagrammatical Operation

Figure 4:
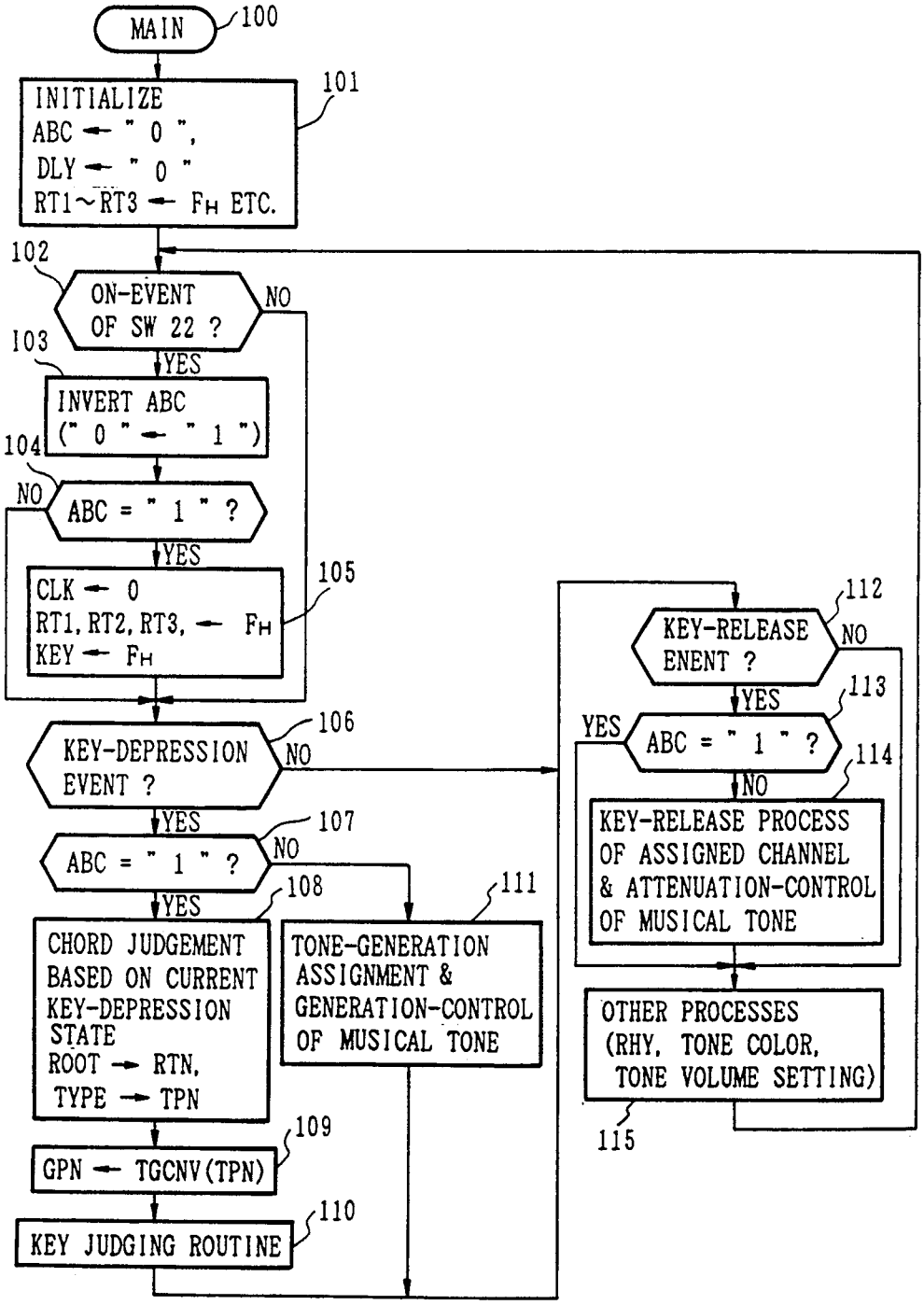
FIGS. 4 to 9 are drawings showing flowcharts whose programs are to be executed by a microcomputer illustrated in FIG. 1.

When the power switch (not shown) is on, the CPU 62 starts to execute the main program which starts from step 100 shown in FIG. 4. In step 101, several data in the working memory 63 are initialized In such initialized state, automatic accompaniment flag ABC and passing-time data DLY are both set at "0". In addition, root data RTl to RT3 are set as "$F_H$" (where suffix "H" denotes that the data "F" is expressed by the hexadecimal notation) which means that the chord root is not determined. Herein, the automatic accompaniment flag ABC at "1" indicates that the automatic accompaniment is performed, while ABC at "0" indicates that the automatic accompaniment is not performed. The passing-time data DLY indicates the passe time from the time when the preceding chord is detected. The initial value of DLY is set at "8", and then the DLY is decremented to "0". The root data RTI, RT2, RT3 indicate the chord roots of the current chord, preceding chord and previous chord. The value of each root data varies from "0" to "11", by which any one of C tone to B tone is designated.

After completing the above-mentioned initialization process of step 101, the CPU 62 will execute the circulating processes of steps 102 to 115.

In step 102, it is judged whether or not the start/stop switch 22 is operated on. If this start/stop switch 22 is not operated, it is judged that no on-event is occurred on the start/stop switch 22, whereby the judgment result of step 102 is "NO". Then, the processing directly proceeds to step 106 from step 102. On the other hand, if the start/stop switch 22 is operated, the judgment result of step 102 turns to "YES", so that the processing proceeds to step 103 wherein the value of the automatic accompaniment flag ABC is inverted. In this inversion, the value "1" is inverted to "0", while the value "0" is inverted to "1". In next step 104, it is judged whether or not the inverted ABC is at "1". In the case where the automatic accompaniment has been stopped but is not started yet, the automatic accompaniment flag ABC is at "1", so that the judgment result of step 104 is "YES". In this case, the processing proceeds to step 105 from step 104, wherein the tempo count data CLK is initialized to "0". In addition, all of the root data RTl, RT2, RT3 and key data KEY are set to "$F_H$". Incidentally, the key data KEY indicates the determined key, wherein it varies from "0" to "11" in order to designate any one of the C key to B key. On the other hand, in the case where the automatic accompaniment has been performed but is now stopped, the automatic accompaniment flag ABC is at "0". Therefore, the judgment result of step 104 is "NO", so that the processing proceeds to step 106.

In step 106, it is judged whether or not any key-depression event is occurred on the keyboard 10. If there is no key-depression event, the judgment result of step 106 is "NO"s that the processing directly proceeds to step 112 from step 106. On the other hand, if there is the key-depression event, the judgment result of step 106 turns to "YES" so that the processing proceeds to step 107 wherein it is judged whether or not the ABC is at "1".

If the automatic accompaniment flag ABC is at "1" so that the automatic accompaniment is not performed, the judgment result of step 107 is "YES". Then, the processing proceeds to step 108 wherein the working memory 63 inputs the key codes KC concerning all of the depressed keyboard-keys from the key switch circuit 10*a* via the bus 30. Based on the inputted key codes KC, the known chord detecting process is executed by referring to the chord detecting table 71*a*.

Next, brief description will be given with respect to this chord detecting process. By use of the key code KC, the data of twelve bits (corresponding to the C tone to B tone) is formed, wherein "1" is placed at the bit corresponding to the note name of the depressing keyboard-key, while "0" is placed at the bit corresponding to the note name of the keyboard-keys which is not depressed. This 12-bit data is subject to the bit-rotation by one bit by every time. Such 12-bit data is then compared to the chord constituent note pattern data from the chord detecting table 71*a* by each chord type. When this 12-bit data coincides with the chord constituent note pattern data, the chord type corresponding to the chord constituent note pattern data is determined as the chord type designated by the keyboard 10. In addition, the bit-rotation times is determined as the chord root.

In consideration of the mis-touch, the chord designation concerning the tension chord and another chord designation made by partially omitting some chord constituent notes, even if all bits of the 12-bit data do not coincide with those of the chord constituent note pattern data, it is assumed that the coincidence between these two data is obtained when the 12-bit data is similar to the chord constituent note pattern data. Thus, one of eight kinds of chord types corresponding to the 12-bit data is determined. Then, in step 108, the value (0-11) indicative of the root of the determined chord is set and stored as new root data RTN. In addition, the value (0-7) indicative of the chord type of the determined chord is set and stored as new type data TPN.

After completing the process of step 108, the processing proceeds to next step 109 wherein the chord group to which the new type data TPN belongs is determined and the value (0-3) indicative of such chord group is set and stored as new chord group data GPN. In this case, the CPU 62 looks at the chord group table 71*b* to thereby read chord group data TGCNV from this table 71*b* by using the new type data TPN as the address. This read data TGCNV is then set and stored as new chord group data GPN. Next, the key judging routine is executed in step 110, wherein the detailed description of this routine will be given later. In this routine, the key corresponding to the performance of the keyboard 10 is determined in response to the chords designated by the keyboard 10. Then, the key data KEY is set as the value (0-11) indicative of the determined key. Thereafter, the processing proceeds to step 112.

Meanwhile, when the automatic accompaniment flag ABC is at "0" so that the automatic accompaniment is not performed, the judgment result of step 107 is "NO" so that the processing proceeds to step 111. In this step 111, the working memory 63 inputs the key code KC concerning the depressing keyboard-keys from the key switch circuit 10*a* via the bus 30. Then, the assigning process is made, by which the key code KC is assigned to one of n musical tone channels of the accompaniment tone signal generating circuit 42. Thereafter, channel number data indicative of the assigned musical tone channel, the key code KC and key-on signal KON are supplied to the accompaniment tone signal generating circuit 42 via the bus 30. As a result, this circuit 42 forms the musical tone signal having the tone pitch corresponding to the key code KC, i.e., the depressed keyboard-key in the assigned musical tone channel. This musical tone signal is fed to the sound system 43, from which the corresponding musical tone is sounded.

In step 112, it is judged whether or not there is the key-release event concerning the keyboard-key to be released. If there is no key-release event so that the judgment result of step 112 is "NO", the processing proceeds to step 115. If there is the key-release event so that the judgment result of step 112 is "YES", the processing proceeds to step 113 wherein it is judged whether or not the automatic accompaniment flag ABC is at "1".

When the ABC is at "1" so that the automatic accompaniment is performed, the judgment result of step 113 turns to "YES" so that the processing proceeds to step 115.

On the other hand, if the ABC is at "0" so that the automatic accompaniment is not performed, the judgment result of step 113 is "NO" so that the processing proceeds to step 114. In this step 114, the working memory 63 inputs the key code KC concerning th released keyboard-key from the key switch circuit 10*a* via the bus 30. Then, the CPU 62 searches the musical tone channel to which such key code KC is assigned. Thereafter, the channel number data indicative of such searched musical tone channel and the key-off signal KOF are fed to the accompaniment tone signal generating circuit 42 via the bus 30. As a result, this circuit 42 attenuates and finally stops the musical tone signal in the musical tone channel designated by the above channel number data. The sound system 43 stop the generation of the musical tone corresponding to the above musical tone signal.

In step 115, the CPU 62 executes other processes, by which the operations of the rhythm selecting switches 21, tempo control 23, rhythm tone volume control 24, accompaniment tone color selecting switches 25 and accompaniment tone volume controls 26 are detected. Thus, rhythm kind data RHY indicative of the rhythm kind is set; tempo data TEMP indicative of the tempos of rhythm and accompaniment is fed to the tempo oscillator 50 via the bus 30; and the data indicative of the tone color and tone volume are fed to the accompaniment tone signal generating circuit 42 via the bus 30. Then, the tempo oscillator 50 outputs the tempo clock signal TCLK having the frequency corresponding to the tempo data TEMP, and the percussive tone signal generating circuit 41 and accompaniment tone signal generating circuit 42 generate the musical tone signal having the tone color and tone volume corresponding to the above data indicative of the tone color and tone volume.

As described above, in the execution of the circulating processes of steps 102 to 115 of the main program, the generation of the musical tone corresponding to the key-depression or key-release event of the keyboard 10 is controlled when the automatic accompaniment is not performed (i.e., ABC=0), while the chord name and chord group corresponding to the key-depression or key-release event of the keyboard 10 is detected and the key is determined when the automatic accompaniment is performed (i.e., ABC=1).

Figure 5:
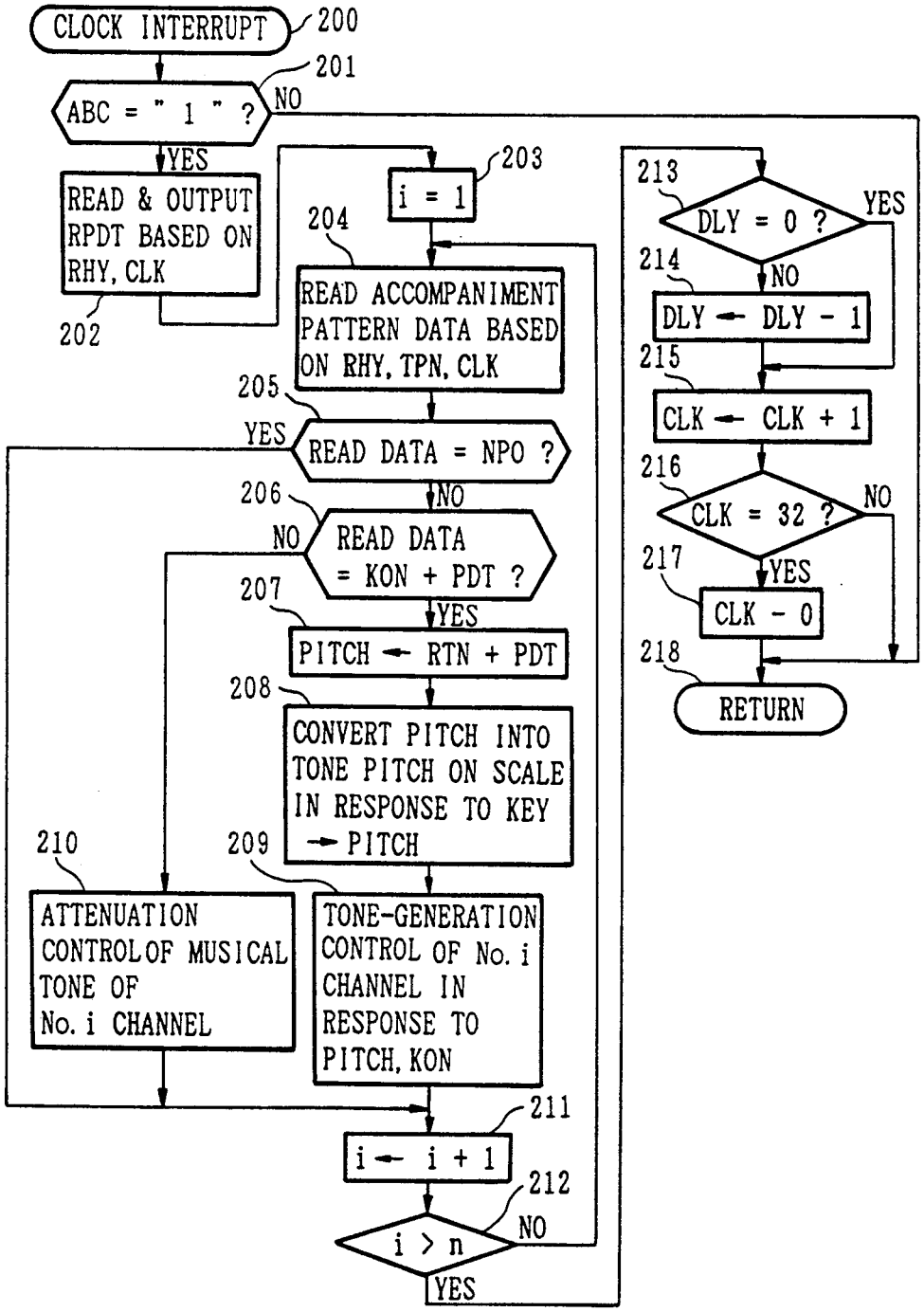

During the execution of the main program, when the tempo oscillator 50 outputs the tempo clock interrupt signal TCLK, the CPU 62 starts to execute the clock interrupt program from step 200 in FIG. 5. In step 201, it is judged whether or not the automatic accompaniment flag ABC is at "1". If this ABC is set at "1" due to the process of step 103 shown in FIG. 4, the judgment result of step 201 is "YES" so that the processing proceeds to step 202 and the following steps, wherein the generations of the percussive tone and accompaniment tone are to be controlled. If the ABC is at "0", the generations of the percussive tone and accompaniment tone are not controlled but the execution of the clock interrupt program is terminated in step 218.

In step 202, the CPU 62 looks at the rhythm pattern memory 72 in response to the rhythm kind data RHY and tempo count data CLK. Thus, all of the rhythm pattern data RPDTl, RPDT2, ... concerning the selected rhythm kinds indicated by RHY and the timings indicated by CLK are read from the rhythm pattern memory 72, and these rhythm pattern data are fed to the percussive tone signal generating circuit 41 via the bus 30. As a result, this circuit 41 forms the musical tone signal corresponding to the rhythm pattern data, which is then sent to the sound system 43. Thus, the sound system 43 sounds the corresponding percussive tones. If the data NOP is read from the rhythm pattern memory 72, this data is not fed to the percussive tone signal generating circuit 41, so that the generation of the percussive tone signal is not controlled.

After completing the process of step 202, the processing proceeds to step 203 wherein a variable i is set at "1". This variable i designates one of n series of accompaniment pattern memories 73-1 to 73-n, so that it varies from "1" to "n". In step 204, based on the rhythm kind data RHY, new type data TPN and tempo count data CLK, the CPU 62 refers to No.i series of accompaniment pattern memories 73-i. From these memories, the CPU 62 reads out the accompaniment pattern data corresponding to the selected rhythm indicated by RHY, chord type indicated by TPN and concerning the timing indicated by CLK. Thereafter, the kind of such read accompaniment pattern data is judged b processes of steps 205 and 206.

More specifically, if the read accompaniment pattern data concerns the key-on data KON and interval data PDT, the judgment result of step 205 is "NO" but the judgment result of step 206 is "YES". Then, the processing proceeds to step 207 wherein the pitch data PITCH indicative of the tone pitch of the accompaniment tone is calculated by adding the interval data PDT to the new root data RTN indicative of the chord root designated by the operations of the keyboard 10. In next step 208, the CPU 62 looks at the key conversion table shown in FIG. 3C based on the key data KEY and pitch data PITCH. This table 74 converts the pitch data PITCH into another pitch data which is included in the scale of the key indicated by the key data KEY. In particular case, the pitch data PITCH indicates the C tone whereas the current key is set to the B key, for example. In this case, the increment value "+1" is read from the table 74 and then added to the pitch data PITCH, whereby the pitch data PITCH is converted into another pitch data indicative of C# tone included in the scale of the B key. Incidentally, if the key has not been determined, the increment value "0" must be added to the pitch data PITCH, so that the pitch data PITCH will no be changed substantially.

After completing the process of step 208, the processing proceeds to step 209 wherein the converted pitch data PITCH, key-on signal KON and channel number data i are all supplied to the accompaniment tone signal generating circuit 42 via the bus 30. As a result, the accompaniment tone signal generating circuit 42 forms the musical tone signal having the tone pitch corresponding to the pitch data PITCH in No.i musical tone channel, which is then fed to the sound system 43. In this case, it is possible to generate n accompaniment tones such as the arpeggio tones, bass tones, chords etc. which concerns the chord designated by the keyboard 10 and the key to be automatically determined. However, actually, the sound system 43 generates some of these n accompaniment tones concerning the No.i series.

Meanwhile, if the accompaniment pattern data which is read from the accompaniment pattern memory 73-i in the process of the foregoing step 204 indicates the key-off data KOF, the judgment results of steps 205, 206 both turn to "NO" so that the processing proceeds to step 210. In this step 210, the key-off data KOF and channel number data i are both fed to the accompaniment tone signal generating circuit 42 via the bus 30. As a result, based on the key-off data KOF, this circuit 42 attenuates the accompaniment tone signal which is generating in the No.i musical tone channel. Then, the generation of this accompaniment tone signal is terminated. So, the sound system 43 gradually fades out the accompaniment tone of No.i series. After completing this process of step 210, the processing proceeds to step 211.

Further, if the accompaniment pattern data read from the accompaniment pattern memory 73-i indicates the data NOP, the judgment result of step 205 is "YES" so that the processing directly proceeds to step 211 from step 205. In this case, the processes concerning the accompaniment tone are not executed.

After executing the processes concerning the No.i series, "1" is added to the variable i in step 211. While this added variable i+1 is not larger than n, the judgment result of step 212 is "NO". Thus, the accompaniment tone generation control routine consisting of steps 204 to 210 is to be executed again, by which the generations of the No.1 to No.n series of accompaniment tones will be controlled.

During the execution of the circulating processes of steps 204 to 212, when the variable i becomes larger than n, the judgment result of step 212 turns to "YES". Then, the processing proceeds to the passing time data DLY renewing routine consisting of steps 213, 214 and the tempo count data CLK renewing routine consisting of steps 215 to 217. In first step 213 of the passing time data DLY renewing routine, it is judged whether or not the passing time data DLY is at "0". Only, in the case where the DLY is not at "0" so that the judgment result of step 213 is "NO", "1" is subtracted from the DLY in step 214. Thus, the passing time data DLY which is initialized to "8" in the preceding chord designation is decremented by "1" every time the tempo clock interrupt signal TCLK is generated, until the DLY reaches "0". In first step 215 of the tempo count data CLK renewing routine, "1" is added to the tempo count data CLK so that the CLK is incremented. In next step 214, it is judged whether or not the incremented tempo count data CLK reaches "32". If the tempo count data CLK is smaller than "32", the judgment result of step 216 is "NO" so that the execution of this clock interrupt program is terminated in step 218. When the CLK reaches "32", the judgment result of step 216 turns to "YES" so that the processing proceeds to step 217 wherein the CLK is initialized to "0". Thereafter, the execution of the clock interrupt program is terminated in step 218.

As described above, every time the tempo clock interrupt signal TCLK is generated, the clock interrupt program is executed. However, if the automatic accompaniment flag ABC is at "0", this program is not substantially executed. In contrast, if the ABC is at "1", the microcomputer 60 controls the generation of the percussive tone and the generation of the accompaniment tone corresponding to the rhythm kind, designated chord and key.

(2) Key Judging Operation

Next, detailed description will be given with respect to the key judging routine for setting the key data KEY which is determined in response to the chord performance of the keyboard 10 and then used for generating the automatic accompaniment tone.

Figure 6:
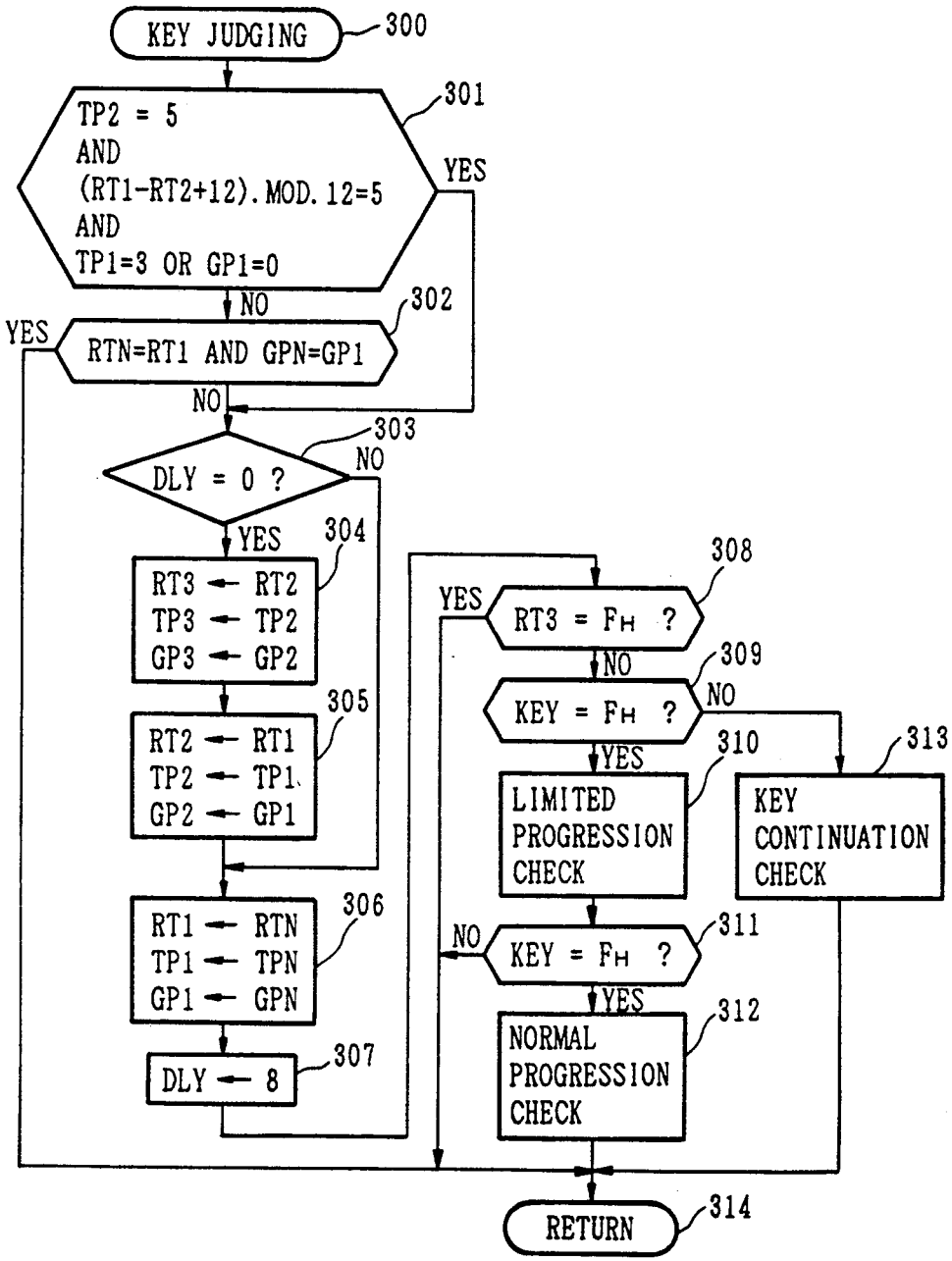

As described before, this key judging routine is executed in step 110 of the main program (see FIG. 4), and the detailed flowchart thereof is shown in FIG. 6. This key judging routine is started from step 300. By executing processes of steps 304 to 306, several kinds of data such as the root data RT3, RT2, RTl, type data TP3, TP2, TPI, chord group data GP3, GP2, GPl are renewed and set. Herein, RT3, TP3, GP3 concerns the previously detected chord; RT2, TP2, GP2 concerns the precedingly detected chord; and RTl, TPl, GPl concerns the currently detected chord. However, in cases (a) of "assumed same chord" and (b) of "passing chord" described below, abovementioned several kinds of data are not renewed and set.

(a) Assumed Same Chord

In the case where the preceding chord is equivalent to the current chord with respect to the chord root and chord group, it is assumed that the current chord is identical to the preceding chord. This current chord is called as the "assumed same chord" of the preceding chord.

However, even in the above-mentioned case, such assumption is not made in the following condition.

Namely, the type of the previous chord is 7th, the root of the preceding chord is higher than that of the previous chord by five semitones, and the preceding chord belongs to any one of the types M, $M_7$, 6th, m.

In the above-mentioned condition, the current chord is not assumed as the assumed same chord but the normal chord.

(b) Passing Chord

In the case where the new chord is not designated before the time of quarter note has passed after the preceding chord is detected (or designated), it is assumed that such preceding chord is not designated. This preceding chord is called as the "passing chord".

The judging process of step 301 in FIG. 6 concerns the exceptional case of the assumed same chord. More specifically, the condition where the type of the previous chord is 7th is detected by judging whether or not the type data TP2 is equal to "5". The condition where the root of the preceding chord is higher than that of the previous chord by five semitones is detected by judging whether or not the operation result of "(RT1-RT2+12).MOD.12" is equal to "5". Further, the condition where the preceding chord belongs to any one of the types M, $M_7$, 6th, m is detected by judging whether or not the type data TPl is equal to "3" or whether or not the chord group data GPl is equal to "0". At the timings of steps 301, 302, the data RTl-RT3, TPl-TP3, GPl-GP3 concerning the previous chord, preceding chord and current chord are not renewed. Therefore, the data RTI, TPI, GPI concern the preceding chord, and other data RT2, TP2 concern the previous chord. In addition, the operation result of "A.MOD.12" indicates the remainder of "A/12". In the specific case where the above-mentioned three conditions are established, the judgment result of step 301 turns to "YES" so that the processing skips step 302 and directly proceeds to step 303. In other cases except for this specific case, the judgment result of step 301 is "NO" so that the processing proceeds to step 302.

The judging process of step 302 concerns the detection of the foregoing assumed same chord. The condition where the current chord is equivalent to the preceding chord with respect to the root and chord group is detected by judging whether or not the new root data RTN and new chord group data GPN are respectively identical to the root data RTl and chord group data GPl. Herein, these data RTN, GPN respectively indicating the root and chord group of the current chord are set in steps 108, 109 in FIG. 5. In the case where the above-mentioned conditions of "RTN=RT1" and "GPN=GP1" are established, the judgment result of step 302 turns to "YES" so that the processing directly proceeds to step 314 from step 302, whereby the execution of this key judging routine is terminated. In other cases, the judgment result of step 302 is "NO" so that the processing proceeds to step 303.

The judging process of step 303 concerns the detection of the passing chord. In short, by judging whether or not the passing time data DLY becomes equal to "0", it is possible to judge whether or not the time of quarter note has passed after the preceding chord is detected. In this case, until the passing time reaches equal to the time of quarter note, the judgment result of step 303 is "NO" so that the processing directly proceeds to step 306. After the passing time exceeds over the time of quarter note, the judgment result of step 303 turns to "YES" so that the processing proceeds to next step 304.

As described above, when the current chord is not the passing chord and assumed same chord of the preceding chord, the judgment result of step 302 is "NO" (or the judgment result of step 301 is "YES" in the exceptional case of the assumed same chord) and the judgment result of step 303 is "YES", so that the processing proceeds to step 304. In step 304, the data RT3, TP3, GP3 concerning the previous chord are renewed to the data RT2, TP2, GP2 concerning the preceding chord to be previously set. In next step 305, the data RT2, TP2, GP2 concerning the preceding chord are renewed to the data RTl, TPI, GPl concerning the current chord to be precedingly set. In step 306, the data RTl, TPl, GPI concerning the current chord are respectively renewed to the new root data RTN, new type data TPN and new chord group data GPN which are newly set in the foregoing processes of steps 108, 109 in FIG. 4. In step 307, the passing time data DLY is initialized to "8" in order to detect the next passing chord. Then, the processing proceeds to step 308.

When the newly designated chord is not the assumed same chord but the passing chord of the current chord before the chord is renewed, the judgment result of step 302 is "NO" (or the judgment result of step 301 is "YES" in the exceptional case of the assumed same chord), and the judgment result of step 303 is "NO". Then, due to the processes of steps 306, 307, only the data RTl, TPl, GPl concerning the current chord are renewed, and the passing time data DLY is initialized, so that the processing proceeds to step 308. In other words, when the next chord is newly designated after the current chord is judged as the passing chord of the preceding chord, the judgements of assumed same chord and passing chord concerning the next chord are made based on the current chord.

Further, when the current chord is the assumed same chord of the preceding chord, the judgment result of step 302 is "YES" so that the processing directly proceeds to step 314.

In step 308, it is judged whether or not the root data RT3 of the previous chord is the data "$F_H$". Similar to other root data RTI, RT2 of the current chord and preceding chord, this root data RT3 is initialized to $F_H$ by the processes of steps 101, 105 in FIG. 4. So, if three or more chords are not designated by the keyboard 10, this root data RT3 remains at $F_H$. In this case, the judgment result of step 308 is "YES" so that the processing proceeds to step 314, whereby the execution of this key judging routine is terminated. This means that in order to judge the key, the chord data concerning three or more chords to be continuously designated are necessary. Meanwhile, when the chord designation is made more than three times after the start timing of the performance, the root data RT3 is not at $F_H$ so that the judgment result of step 308 is "NO". Then, the substantial key judging processes of steps 309 to 313 will be executed.

Since the key determining condition differs based on whether or not the key has been already determined, the above judging process of step 308 is made. More specifically, when the key data KEY is set at the value "$F_H$" indicating that the key has not been determined yet, the judgment result of step 308 turns to "YES" so that the CPU 62 will execute the limited progression check routine (see FIG. 7) in step 310. B this routine, certain key is determined prior to other keys in accordance with the limited progression condition of the previous three chords which will be described later. In addition, the key data KEY is set to the value (0-11) indicative of the determined key. On the other hand, when the key is determined in step 310, the key data KEY is not at "$F_H$" so that the judgment result of step 311 turns to "NO". Then, the execution of this key judging routine is terminated in step 314. In the case where the key is not determined in step 310, the judgment result of step 311 turns to "YES" so that the CPU 62 executes the normal progression check routine (see FIG. 8) in step 312. In this routine, the key is determined in accordance with the progression condition of the previous three chords other than the foregoing limited progression condition. In addition, the key data KEY is set to the value (0-11) indicative of the determined key. Then, the execution of this key judging routine is terminated in step 314.

Meanwhile, if the key has been already determined so that the key data KEY is not at "$F_H$" when executing the judging process of step 309, the processing proceeds to step 313 from step 309, wherein the key continuation check routine (see FIG. 9) is executed. In this routine, it is determined that the determined key is continued in accordance with the key continuation condition which will be described later. Then, the execution of this key judging routine is terminated in step 314.

(2-1) Limited Progression Check Routine

Next, detailed description will be given with respect to the limited progression check routine by referring to the flowchart illustrated in FIG. 7. First, several limited progression conditions are listed as follows.

(a) The root name of the current chord is set as the key name, under the condition where the root of the preceding chord is identical to that of the previous chord; the root of the current chord is higher than that of the preceding chord by seven semitones (or lower by five semitones); the types of the previous chord and current chord are respectively any one of the types M, $M_7$, 6th (i.e., the major group) but the type of the preceding chord is any one of the types m, $m_7$ (i.e., the minor group). For example, in order to designate the C key, the chords can be varied as F, $F_{M7}$, $F_{6th}$→Fm, $Fm_7$→C, $C_{M7}$, $C_{6th}$.

(b) The note name which is higher than the root of the current chord by eight semitones is set as the key name, under the condition where the root of the preceding chord is identical to that of the previous chord; the root of the current chord is higher than that of the preceding chord by eleven semitones (or lower by one semitone); the type of the previous chord is any one of the types M, $M_7$, 6th (i.e., major group) but the types of the preceding chord and current chord are respectively any one of the types m, $m_7$ (i.e., minor group). For example, in order to designate the C key, the chord can be varied as F, $F_{M7}$, $F_{6th}$→Fm, $Fm_7$→Em, $Em_7$.

(c) The root name of the current chord is set as the key name, under the condition where the root of the preceding chord is higher than that of the previous chord by five semitones (or lower by seven semitones); the root of the current chord is higher than that of the preceding chord by two semitones (or lower by ten semitones); the type of the previous chord is any one of the types M, $M_7$, 6th (i.e., the major group), the type of the preceding chord is any one of the types 7th, 7SUS4 (i.e., seventh group) and the type of the current chord is $M_7$. For example, in order to designate the C key, the chords can be varied as F, $F_{M7}$, $F_{6th}$→$A\#_{7th}$, $A\#_{7SUS4}$→$C_{M7}$.

(d) The root name of the current chord is set as the key name, under the condition where the root of the preceding chord is higher than that of the previous chord by eleven semitones (or lower by one semitone); the root of the current chord is higher than that of the preceding chord by eleven semitones (or lower by one semitone); the type of the previous chord is $m_7$, the type of the preceding chord is one of the types 7th, 7SUS4 (i.e., seventh group) and the type of the current chord is one of the types M, $M_7$, 6th (i.e., major group). For example, in order to designate the C key, the chords can be varied as $Dm_7$ →$C\#_{7th}$, $C\#_{7SUS4}$→C, $C_{M7}$, $C_{6th}$.

(e) The note name which is higher than the root of the current chord by three semitones is set as the key name, under the condition where the root of the preceding chord is higher than that of the previous chord by eleven semitones (or lower by one semitone); the root of the current chord is higher than that of the preceding chord by eleven semitones (or lower by one semitone); the type of the previous chord is $m_7{}^{-5}$ (i.e., minor seven flat five group), the type of the preceding chord is one of the types 7th, 7SUS4 (i.e., seventh group) and the type of the current chord is the type m. For example, in order to designate the C key, the chords can be varied as $Bm_7{}^{-5}$→$A\#_{7th}$, $A\#_{7SUS4}$→Am.

Figure 7:
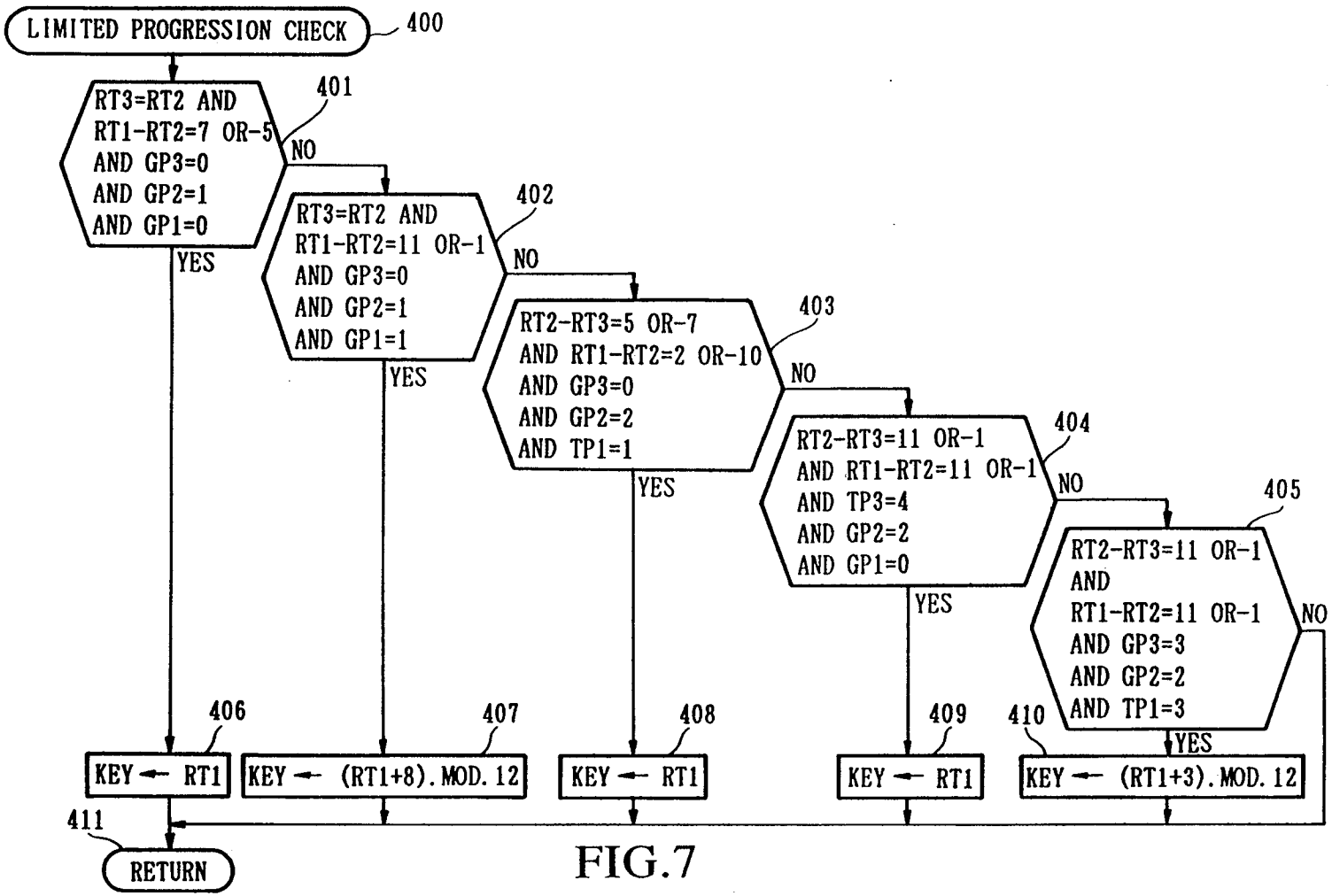

The execution of this limited progression check routine is started from step 400 in FIG. 7. Then, the judging processes concerning the above-mentioned limited progression conditions (a) to (e) are made based on the data RT3, TP3, GP3 concerning the previous chord, data RT2, TP2, GP2 concerning the preceding chord and data RTl, TPl, GPl concerning the current chord in steps 401 to 405, while the key data KEY is set in response to the limited progression conditions (a) to (e) based on the root data RTl of the current chord in steps 406 to 410. More specifically, when the limited progression condition (a) is established, the judgment result of step 401 turns to "YES" so that the processing proceeds to step 406 wherein the key data KEY is set to the root data RTl indicative of the root of the current chord. In case of the condition (b), the judgment result of step 402 is "YES" so that the processing proceeds to step 407 wherein the key data KEY is set to the tone pitch data "(RT1+8).MOD.12" which is higher than the root (RTl) of the current chord by eight semitones. In case of the condition (c), the judgment result of step 403 is "YES" so that the processing proceeds to step 408 wherein the key data KEY is set to the root data RTl of the current chord. In case of the condition (d), the judgment result of step 404 is "YES" so that the processing proceeds to step 409 wherein the key data KEY is set to the root data RTl of the current chord. In case of the condition (e), the judgment result of step 405 is "YES" so that the processing proceeds to step 410 wherein the key data KEY is set to the tone pitch data "(RT1+3).MOD.12" which is higher than the root (RTl) of the current chord by three semitones. After completing these processes of steps 406 to 410, the execution of this limited progression check routine is completed in step 411.

Meanwhile, if any one of the conditions (a) to (e) is not established, all of the judgment results of steps 401 to 405 are "NO", so that the processing finally proceeds to step 411. Thus, without setting the key data KEY, the execution of this limited progression check routine is terminated.

(2-2) Normal Progression Check Routine

Next, detailed description will be given with respect to the normal progression check routine by referring to the flowchart shown in FIG. 8. First, the normal progression conditions are listed as follows.

(a) The note name which is higher than that of the previous chord by five semitones is set as the key, under the condition where the root of the preceding chord is higher than that of the previous chord by five semitones; the type of the previous chord is any one of the types 7th, 7SUS4 (i.e., seventh group); the type of the preceding chord is any one of the types M, $M_7$, 6th (i.e., major group); and the current chord is on the scale to be set when the note name which is higher than the root of the previous chord by five semitones is set as the key. For example, in order to designate the C key, the chord can be varied as $G_{7th}$, $G_{7SUS4}$→C, $C_{M7}$, $C_{6th}$→chord on the scale of C key. Herein, such chord on the scale will be described later.

(b) The note name which is higher than the root of the previous chord by five semitones is set as the key, under the condition where the root of the preceding chord is higher than that of the previous chord by two semitones; the type of the previous chord is any one of the types 7th, 7SUS4 (i.e., seventh group); the type of the preceding chord is any one of the types m, m7 (i.e., minor group); and the current chord is on the scale to be set when the note name which is higher than the root of the previous chord by five semitones is set as the key. For example, in order to designate the C key, the chord can be varied as $G_{7th}$, $G_{7SUS4}$→Am, $Am_7$→chord on the scale of C key.

(c) The note name which is higher than the root of the previous chord by five semitones is set as the key, under the condition where the root of the preceding chord is higher than that of the previous chord by nine semitones; the type of the previous chord is one of the types 7th, 7SUS4 (i.e., seventh group) and the type of the preceding chord is one of the types m, $m_7$ (i.e., minor group) or types 7th, 7SUS4; the current chord is on the scale to be set when the note name which is higher than the root of the previous chord by five semitones is set as the key. For example, in order to designate the C key, the chord can be varied as $G_{7th}$, $G_{7SUS4}$→Em, $Em_7$, $E_{7th}$, $E_{7SUS4}$→chord on the scale of C key.

(d) The note name which is higher than the root of the previous chord by five semitones is set as the key, under the condition where the root of the preceding chord is higher than that of the previous chord by ten semitones; the type of the previous chord is one of the types 7th, 7SUS4 (i.e., seventh group) and the type of the preceding chord is one of the types M, $M_7$, 6th (i.e., major group); and the current chord is on the scale to be set when the note name which is higher than the root of the previous chord by five semitones is set as the key. For example, in order to designate the C key, the chord can be varied as $G_{7th}$, $G_{7SUS4}$→F, $F_{M7}$, $F_{6th}$→chord on the scale of C key.

(e) The note name (denoted to as the reference note) which is higher than the root of the previous chord by ten semitones is set as the key, under the condition where the root of the preceding chord is higher than that of the previous chord by five semitones; the type of the previous chord is one of the types m, $m_7$ (i.e., minor group), and the type of the preceding chord is one of the types 7th, 7SUS4 (seventh group) or the type M (i.e., major); and the current chord is on the scale to be set when the reference note is set as the key, or the current chord is the major chord (i.e., M type) whose root is higher than the reference note by seven semitones. For example, in order to designate the C key, the chord can be varied as Dm, $Dm_7$→$G_{7th}$, $G_{7SUS4}$, $G_M$→chord on the scale of C key, $G_M$.

(f) The note name (denoted to as the reference note) which is higher than the root of the previous chord by ten semitones is set as the key, under the condition where the root of the preceding chord is higher than that of the previous chord by two semitones; the type of the previous chord is one of the types m, $m_7$ (i.e., minor group), and the type of the preceding chord is one of the types m, $m_7$, types 7th, 7SUS4 (i.e., seventh group) or the type M (i.e., major); and the current chord is on the scale to be set when the reference note is set as the key, or the current chord is the major chord (i.e., type M) whose root is higher than the reference note by seven semitones. For example, in order to designate the C key, the chord can be varies as Dm, $Dm_7$→Em, $Em_7$, $E_{7th}$, $E_{SUS4}$, EM→chord on the scale of C key, $G_M$.

(g) The note name (denoted to as the reference note) which is higher than the root of the previous chord by the semitones is set as the key, under the condition where the root of the preceding chord is higher than that of the previous chord by nine semitones; the type of the previous chord is one of the types m, $m_7$ (i.e., minor group), and the type of the preceding chord is $m_7^{-5}$ (i.e., minor seven flat five); and the current chord is on the scale to be set when the reference note is set as the key, or the current chord is the major chord (i.e., type M) whose root is higher than the reference note by seven semitones. For example, in order to designate the C key, the chord can be varied as Dm, $Dm_7$→$Bm_7^{-5}$→chord on the scale of C key, $G_M$.

(h) The note name (denoted to as a reference note) which is higher than the root of the previous chord by seven semitones is set as the key, under the condition where the root of the preceding chord is higher than that of the previous chord by two semitones; the type of the previous chord is one of the types M, $M_7$, 6th (i.e., major group); the type of the preceding chord is one of the types 7th, 7SUS4 (i.e., seventh group) or the type M (i.e., major); the current chord is the chord on the scale when the reference note is set as the key, or the current chord is the M chord whose root is higher than the reference note by seven semitones. For example, in order to designate the C key, the chord can be varied as F, $F_{M7}$, $F_{6th}$→$G_{7th}$, $G_{7SUS4}$, $G_M$→chord on the scale of C key, $G_M$.

(i) The note name (denoted to as the reference note) which is higher than the root of the previous chord by seven semitones is set as the key, under the condition where the root of the preceding chord is higher than that of the previous chord by eleven semitones; the type of the previous chord is one of the types M, $M_7$, 6th (i.e., major group); the type of the preceding chord is one of the types m, $m_7$ (i.e., minor group), one of the types 7th, 7SUS4 (i.e., seventh group) or the type M (i.e., major); the current chord is the chord on the scale when the reference note is set as the key, or the current chord is the M chord whose root is higher than the reference note by seven semitones. For example, in order to designate the C key, the chord can be varies as F, $F_{M7}$, $F_{6th}$→Em, $Em_7$, $E_{7th}$, $E_{7SUS4}$, $E_M$→chord on the scale of C key, $G_M$. (j) The note name (denoted to as the reference note) which is higher than the root of the previous chord by seven semitones is set as the key, under the condition where the root of the preceding chord is higher than that of the previous chord by six semitones; the type of the previous chord is one of the types M, $M_7$, 6th (i.e., major group); the type of the preceding chord is $m_7^{-5}$ (i.e., minor seven flat five); the current chord is the chord on the scale when the reference note is set as the key, or the current chord is the M chord whose root is higher than the reference note by seven semitones. For example, in order to designate the C key, the chord can be varied as F, $F_{M7}$, $F_{6th}$→$Bm_7^{-5}$→chord on the scale of C key, $G_M$.

(k) The note name (denoted to as the reference note) which is higher than the root of the previous chord by eight semitones is set as the key, under the condition where the root of the preceding chord is higher than that of the previous chord by five semitones; the type of the previous chord is one of the types 7th, 7SUS4 (i.e., seventh group) or the type M (i.e., major); the type of the preceding chord is one of the types m, $m_7$ (i.e., minor group); and the current chord is the chord on the scale when the reference note is set as the key. For example, in order to designate the C key, the chord can be varied as $E_{7th}$, $E_{7SUS4}$, $E_M$→Am, $Am_7$→chord on the scale of C key.

(1) The note name (denoted to as the reference note) which is higher than the root of the previous chord by eight semitones is set as the key, under the condition where the root of the preceding chord is higher than that of the previous chord by ten semitones; the type of the previous chord is one of the types 7th, 7SUS4 (i.e., seventh group) or the type M (i.e., major); the current chord is the chord on the scale when the reference note is set as the key. For example, in order to designate the C key, the chord can be varied as $E_{7th}$, $E_{7SUS4}$, $E_M$→Dm, $Dm_7$→chord on the scale of C key.

(m) The note name (denoted to as the reference note) which is higher than the root of the previous chord by eight semitones is set as the key, under the condition where the root of the preceding chord is higher than that of the previous chord by one semitone; the type of the previous chord is one of the types 7th, 7SUS4 (i.e., seventh group) or the type M (i.e., major); the type of the preceding chord is the type M or $M_7$ (major seven);

and the current chord is on the scale when the reference note is set as the key. For example, in order to designate the C key, the chord can be varied as E7th, E7SUS4, $E_M \rightarrow F$, $F_{M7} \rightarrow$chord on the scale of C key.

(n) The note name (denoted to as the reference note) which is higher than the root of the previous chord by eight semitones is set as the key, under the condition where the root of the preceding chord is higher than that of the previous chord by seven semitones; the type of the previous chord is one of the types 7th, 7SUS4 (i.e., seventh group) or the type M (i.e., major); the type of the preceding chord is $m_7{}^{-5}$ (i.e., minor seven flat five); and the current chord is on the scale when the reference note is set as the key. For example, in order to designate the C key, the chord can be varied as $E_{7th}$, $E_{7SUS4}$, $E_M \rightarrow Bm_7{}^{-5} \rightarrow$chord on the scale of C key.

(o) The note name (denoted to as the reference note) which is higher than the root of the previous chord by eight semitones is set as the key, under the condition where the root of the previous chord is higher than that of the preceding chord by three semitones; the type of the previous chord is one of the types 7th, 7SUS4 (i.e., seventh group) or the type M (i.e., major); the type of the preceding chord is one of the types 7th, 7SUS4; and the current chord is on the scale when the reference note is set as the key. For example, in order to designate the C key, the chord can be varied as $E_{7th}$, $E_{7SUS4}$, $E_M \rightarrow G_{7th}$, $G_{7SUS4} \rightarrow$chord on the scale of C key.

(p) The note name (denoted to as the reference note) which is higher than the root of the previous chord by one semitone is set as the key, under the condition where the root of the preceding chord is higher than that of the previous chord by five semitones; the type of the previous chord is $m_7{}^{-5}$ (i.e., minor seven flat five); the type of the preceding chord is one of the types 7th, 7SUS4 (i.e., seventh group), the type M (i.e., major) or one of the types m, $m_7$ (i.e., minor group); and the current chord is on the scale when the reference note is set as the key. For example, in order to designate the C key, the chord can be varied as $Bm_7{}^{-5} \rightarrow E_{7th}$, $E_{7SUS4}$, $E_M$, Em, $Em_7 \rightarrow$chord on the scale of C key.

(q) The note name (denoted to as the reference note) which is higher than the root of the previous chord by one semitone is set as the key, under the condition where the root of the preceding chord is higher than that of the previous chord by six semitones; the type of the previous chord is $m_7{}^{-5}$ (i.e., minor seven flat five); the type of the preceding chord is one of the types M, $M_7$, 6th (i.e., major group); and the current chord is on the scale when the reference note is set as the key.

(r) The note name (denoted to as the reference note) which is higher than the root of the previous chord by one semitone is set as the key, under the condition where the root of the preceding chord is higher than that of the previous chord by three semitones; the type of the previous chord is $m_7{}^{-5}$ (i.e., minor seven flat five); the type of the preceding chord is one of the types m, m7 (i.e., minor group); and the current chord is on the scale when the reference note is set as the key. For example, in order to designate the C key, the chord can be varied as $Bm_7{}^{-5} \rightarrow Dm$, $Dm_7 \rightarrow$chord on the scale of C key.

(s) The note name (denoted to as the reference note) which is higher than the root of the previous chord by one semitone is set as the key, under the condition where the root of the preceding chord is higher than that of the previous chord by ten semitones; the type of the previous chord is $m_7{}^{-5}$ (minor seven flat five); the type of the preceding chord is one of the types m, $m_7$ (i.e., minor group); and the current chord is on the scale when the reference note is set as the key. For example, in order to designate the C key, the chord can be varied as $Bm_7{}^{-5} \rightarrow Dm$, $Dm_7 \rightarrow$chord on the scale of C key.

In the above-mentioned normal progression conditions (a) to (s), "the chord on the scale" means that the notes on the scale of each key are set as the chord constituent notes. In the form of degree expression, this chord can be expressed such as $I_M$, $I_{M7}$, $I_{6th}$, IIm, $IIm_7$, IIIm, $IIIm_7$, $III_{7th}$, $III_{7SUS4}$, $IV_M$, $IV_{M7}$, $IV_{6th}$, $V_{7th}$, $V_{7SUS4}$, VIm, $VIm_7$, $VIIm_7{}^{-5}$. The information concerning these chords are stored in the scale chord detecting table 71*d*. In these chords, the chord III7th includes the notes other than the notes on the scale. However, the notes on the scale frequently emerge within this chord $III_{7th}$. So, this chord is included within the chords on the scale as the exceptional case. Each of the normal progression conditions (a) to (s) corresponds to each of addresses "0" to "18" of the normal chord progression detecting table 71*c*.

Figure 8:
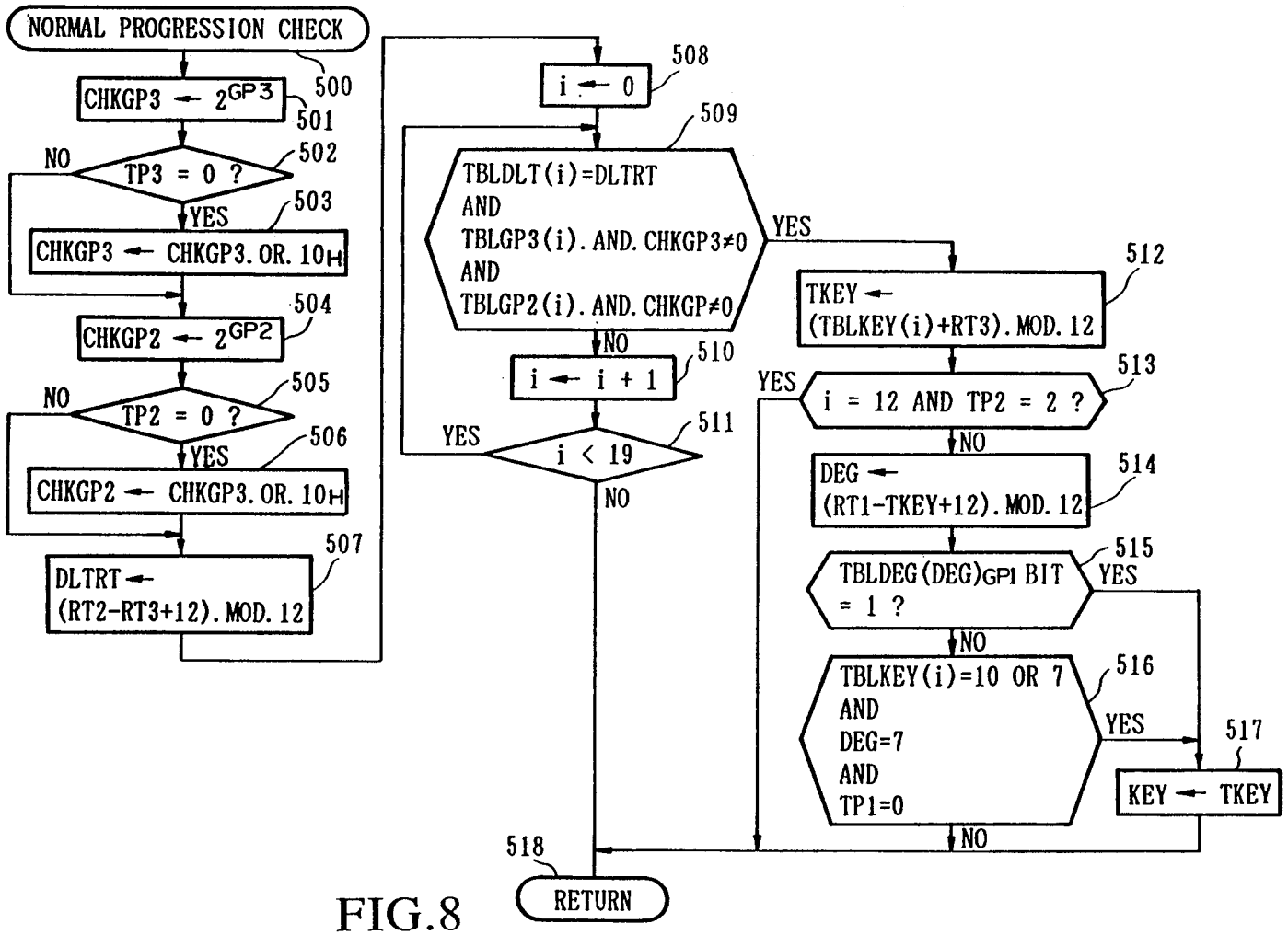

The execution of the normal progression check routine is started from step 500 in FIG. 8. In step 501, chord group check data CHKGP3 concerning the previous chord is formed based on the chord group data GP3 (0-3) and type data TP3 which are formed in the foregoing step 304 in FIG. 6. This chord group check data CHKGP3 consists of five bits. When each of lower four bits of this data CHKGP3 is at "1", each of the major group, minor group, seventh group and minor seven flat five group is designated. When the MSB of this data CHKGP3 is at "1", it is indicated that the type of the previous chord is the major type. In other words, in step 501, the chord group check data CHKGP3 is formed and then stored by executing the following operation (1).

$$CHKGP3 = 2^{GP3} \cdots \quad (1)$$

In next step 502, it is judged whether or not the type of the previous chord is the major type based on the type data TP3 concerning the previous chord. In other words, it is judged whether or not the type data TP3 is at "0" in step 502. If the type of the previous chord is the major type, the judgment result of step 502 is "YES" so that the processing proceeds to step 503 wherein the value "1" is added to the MSB of the chord group check data CHKGP3 by executing the following operation (2).

$$CHKGP3 = CHKGP3.OR.10_H \cdots \quad (2)$$

On the other hand, when the type of the previous chord is not the major type, the judgment result of step 502 is "NO" so that the MSB of the data CHKGP3 remains at "0" (which is set by the process of step 501). Then, the processing proceeds to step 504.

After executing the processes of steps 501 to 503, similar processes of steps 504 to 506 are to be executed, wherein another chord group check data CHKGP2 concerning the preceding chord is to be set.

Next, in step 507, the difference between the roots of the previous chord and preceding chord is calculated in the form of the number of semitones by executing the following operation (3). Then, the calculated result is set and stored as root difference data DLTRT.

$$DLTRT = (RT2 - RT3 + 12).MOD.12 \cdots \quad (3)$$

The above-mentioned chord group check data CHKGP3, CHKGP2 and root difference data DLTRT (which are set by the processes of steps 501 to 507) respectively correspond to the chord group data TBLGP3, TBLGP2 and pitch difference data TBLDLT in the normal chord progression detecting table 71*c*. These data are used for judging the normal progression conditions in step 509.

Next, in step 508, the variable i is initialized to "0". This variable i is added by "1" in step 510 (i.e., $i=i+1$), and then it is compared to "19" in step 511 (i.e., $i<19$). By executing the circulating processes of steps 509 to 511 including the above steps 510–511, the judging process of step 509 is made every time the variable i is incremented by "1", wherein this variable can vary from "0" to "18". This variable i corresponds to the address of the normal chord progression detecting table 71*c*. In step 509, based on the pitch difference data TBLDLT(i) and chord group data TBLGP3(i), TBLGP2(i) designated by the variable i and the root difference data DLTRT, chord group check data CHKGP3, CHKGP2, it is judged whether or not all of the following three conditions can be established:

(i) condition-1,
wherein the pitch difference data TBLDLT(i) is equal to root difference data DLTRT;
(ii) condition-2,
wherein the logical product of the chord group data TBLGP3(i) and chord group check data CHKGP3 is not equal to "0"; and
(iii) condition-3,
wherein the logical product of the chord group data TBLGP2(i) and chord group check data CHKGP2 is not equal to "0".

In order to judge whether or not "1" is at the corresponding bits between TBLGP3(i), CHKGP3 or TBLGP2(i), CHKGP2, the judgment is made on the above condition-2 or condition-3. Thus, the coincidence between these data is judged in its chord group or chord type (i.e., major type). In the circulating processes of steps 509 to 511, when the variable i reaches "19" without detecting an coincidence between these data, it is judged that there is no chord progression corresponding to the normal progression condition. Then, the judgment result of step 511 turns to "NO" so that the processing directly proceeds to step 518, whereby the execution of the normal progression check routine is terminated.

Meanwhile, when the judgment result of step 509 turns to "YES" during the execution of the circulating processes of steps 509 to 511 since the chord progression corresponding to the normal progression condition is detected, the processing proceeds to step 512. In this step 512, based on the key determining data TBLKEY and root data RT3 indicative of th root of the previous chord stored at the address designated by the variable i in the normal chord progression detecting table 71*c*, the note name (e.g., C - B note) indicative of the temporary key is calculated by executing the following operation (4). Then, the data indicative of the calculated note name is set as the temporary key data TKEY.

$$TKEY=[TBLKEY(i)+RT3].MOD.12 \ldots \quad (4)$$

After completing the process of step 512, the processing proceeds to step 513 wherein it is judged whether or not the variable i is at "12" and the type data TP2 concerning the preceding chord is at "2". This judging process of step 513 is necessary, because the foregoing normal progression condition (m) excludes the case where the type of the preceding chord is 6th, while the foregoing step 509 judges that the normal progression condition is established even in such case. More specifically, in the case where the preceding chord belongs to the type 6th, the judgment result of step 513 is "YES", whereby it is judged that there is no chord progression corresponding to the normal progression condition. Thus, the execution of the normal progression check routine is terminated in step 518.

On the other hand, in the case where there is the chord progression corresponding to the normal progression condition so that the judgment result of step 513 turns to "NO", the processing proceeds to step 514 wherein based on the root data RTI and temporary key data TKEY of the current chord, the degree of the root of the current chord against the temporary key is calculated by executing the following operation (5). Then, the calculated result is set as degree data DEG.

$$DEG=(RTI-TKEY+12).MOD.12 \ldots \quad (5)$$

Next, under processes of steps 515, 516, it is judged whether or not the current chord is on the scale of the temporary key, and then it is judged whether or not the current chord is the major chord whose root is higher than the reference note (of the temporary key) in the foregoing normal progression conditions (e) to (j) by seven semitones. More specifically, in step 515, the CPU 62 refers to the scale chord detecting table 71*d* which designates the current chord by the existence of "1" based on the degree of the key from the reference note and the chord group. Then, the chord group data TBLDEG is read from the address designated by the degree data DEG in the table 71*d*. Then, it is judged whether or not the bit GPI (i.e., No.GPI bit) of the read chord group data TBLDEG is at "1", wherein this bit GPI is designated by the chord group data GPI indicative of the chord group of the current chord. In step 516, in order to judge whether or not the normal progression conditions (e) to (j) are established, the CPU 62 judges the condition where the key data TBLKEY is at "10" or "7". In order to detect that the current chord is higher than the reference note by seven semitones, the CPU 62 judges the condition where the degree data DEG is at "7". Further, in order to detect that the current chord belongs to the major type, the CPU 62 judges that the type data TPI is at "0". In step 516, it is judged whether or not the abovementioned three conditions are all established.

When the judgment result of step 515 or 516 is "YES", it is judged that the current chord is on the scale of the temporary key or the current chord is the major chord whose root is higher than the reference note (of the temporary key) in the foregoing normal progression conditions (e) to (j) by seven semitones. In this case, the processing proceeds to step 517 wherein the key data KEY indicative of the finally determined key is set equal to the temporary key data TKEY. After completing the process of step 517, the processing proceeds to step 518 wherein the execution of the normal progression check routine is terminated. When the judgment results of steps 515, 516 are both at "NO", the execution of the normal progression check routine is terminated in step 518 without setting the key data KEY.

(2-3) Key Continuation Check Routine

Figure 9:
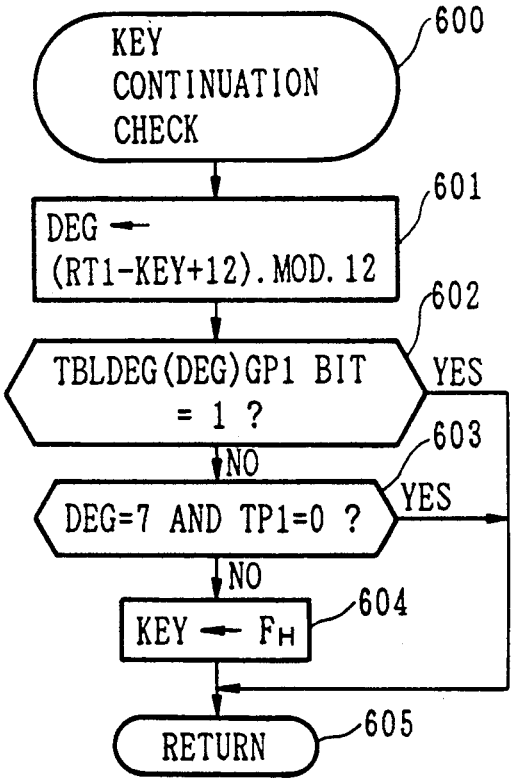

Next, detailed description will be given with respect to the key continuation check routine. This routine as shown in FIG. 9 is started from step 600. Similar to the foregoing step 514, in step 601, the degree of the root of the current chord against the key is calculated by executing the following operation (6) based on the root data RTl and key data KEY of the current chord in step 601. Then, the calculated result is set as the degree data DEG.

$$DEG=(RTl-KEY+12).MOD.12 \ldots \quad (6)$$

In next steps 602, 603, the processes similar to those of the foregoing steps 515, 516 are executed. More specifically, it is judged whether or not the current chord is on the scale of the key or the current chord is the major chord whose root has the note name which is higher than the reference note of the key by seven semitones. If one of the judgment results of steps 602, 603 turns to "YES", the key data KEY is remained at the preceding value. Then, the execution of the key continuation check routine is terminated in step 605. If both of the judgment results of steps 602, 603 are at "NO", the processing proceeds to step 604 wherein the key data KEY is changed to "$F_H$" which does not indicate any key at all. In other words, the key data KEY is cleared in step 604. Thereafter, the execution of the key continuation check routine is terminated in step 605. In such case, the operation similar to that at the performance start timing is to be carried out. More specifically, by executing the limited progression check routine (see FIG. 7) and normal progression check routine (see FIG. 8), the key is newly detected and set.

As is apparent from the operations described heretofore, according to the present embodiment, in response to the key-depressions of the keyboard 10, under the processes of the limited progression check routine (see FIGS. 6, 7) in step 310 and the processes of the normal progression check routine (see FIGS. 6, 8) in step 312 based on the progression of the continuous three chords, the musically adequate key is automatically determined. After the key is determined, under the processes of the key continuation check routine (see FIG. 9) in step 313, the determined key is automatically maintained or canceled. Then, the generations of the automatic accompaniment tones are controlled in response to the automatically determined key. Hence, it is possible to automatically obtain the automatic accompaniment tones having high musical quality. In the key determination or key continuation determination, the passing chord and assumed same chord are removed by the processes of steps 301 to 303 (see FIG. 6). Therefore, it is possible to perform the key determination and key continuation determination with accuracy.

[C]MODIFIED EXAMPLES OF PRESENT EMBODIMENT

The present embodiment according to the present invention can be modified as follows.

(1) In the above-mentioned embodiment, the performer depresses the keyboard-keys of all chord constituent notes when performing the chord performance by the keyboard 10. Instead, it is possible to designate the chord based on the lowest-pitch-note or highest-pitch-note whose keyboard-key is to be depressed. Then, by use of other key-depression notes, the chord type can be designated. In this case, the contents of step 108 in FIG. 4 can be changed such that the chord is detected by the lowest-pitch-note (or highest-pitch-note) to be depressed and other key-depression notes (such as the number of white-keys, black-keys to be depressed).

In addition, it is possible to designate the chord type only by the operable members other than the keyboard-keys. Or, it is also possible to designate the root of chord and chord type by the operable members other than the keyboard-keys. In this case, the chord is detected in response to the operations of the operable members in step 108.

(2) The present embodiment only refers to the keyboard 10 for designating the chord. In addition to this keyboard 10, it is possible to provide another keyboard for the melody performance. In this case, by use of the determined key, it is possible to form the pitch data concerning the duet tones, trio tones which are used as the additional tones of the melody tones. Or, in response to the determined key, it is also possible to form the pitch data concerning the additional tones based on the melody tone and the chord designated by the keyboard 10.

(3) The present embodiment refers to the electronic musical instrument which provides the keyboard 10. However, it is possible to omit the keyboard 10 and provide the external device which inputs the note name information corresponding to the key-depression of each keyboard-key. In response to the inputted note name information, the desirable key is automatically determined. Thus, by only inputting the key information (i.e., note name information) from the apparatus which provides another musical instrument or keyboard, the automatic key designating apparatus according to the present invention can form the optimum accompaniment tone.

As described heretofore, this invention may be practiced or embodied in still other ways without departing from the spirit or essential character thereof. Therefore, the preferred embodiment described herein is illustrative and not restrictive, the scope of the invention being indicated by the appended claims and all variations which come within the meaning of the claims are intended to be embraced therein.

What is claimed is:

1. An automatic key designating apparatus comprising:

(a) chord designating means for sequentially designating chords;

(b) memory means for storing at least first to third chord information respectively indicating a current chord, a preceding chord which immediately precedes the current chord, and a previous chord which is prior to the preceding chord, which are sequentially designated by said chord designating means in time-series manner;

(c) detecting means for detecting a predetermined specific chord progression concerning continuous three chords based on said chord information stored in said memory means; and (d) means for setting key data corresponding to said specific chord progression detected by said detecting means, whereby a desirable key is automatically designated based on said key data.

2. An automatic key designating apparatus comprising:

(a) chord designating means for sequentially designating chords;

(b) memory means for storing at least first to third chord information respectively indicating a current chord, a preceding chord which immediately follows the current chord, and a previous chord which is prior to the preceding chord, which are sequentially designated by said chord designating means in time-series manner;

(c) detecting means for detecting a predetermined specific chord progression corresponding to said previous chord and said preceding chord based on said third chord information concerning said previous chord and said second chord information concerning said preceding chord;

(d) first means for determining a temporary key corresponding to said specific chord progression detected by said detecting means;

(e) judging means for judging whether or not said current chord is on a scale concerning said temporary key based on said first chord information concerning said current chord; and (f) second means for setting said temporary key as a desirable key to be finally determined when said judging means judges that said current chord is on the scale concerning said temporary key, said second means generating key data indicative of said temporary key, whereby said desirable key is automatically designated based on said key data.

3. An automatic key designating apparatus according to claim 1 or 2 wherein, when said chord designating means designates a new chord which has a predetermined relation to a precedingly designated chord, chord information concerning said new chord is prohibited from being stored in said memory means but said first to third chord informations are maintained as they were in said memory means.

4. An automatic key designating apparatus according to claim 1 or 2 further providing:

measuring means for measuring a passing time between a preceding chord designation timing and a next timing when a new chord is designated by said chord designating means; and chord replacing means for replacing said first chord information concerning said current chord by another chord information concerning said new chord but remaining said second and third chord informations concerning said preceding and previous chords as they were in said memory means when said passing time is shorter than a predetermined time.

5. An automatic key designating apparatus comprising:

(a) chord designating means for sequentially designating chords;

(b) key determining means for determining a key in response to a chord progression of said chords designated by said chord designating means;

(c) memory means for storing key data indicative of a determined key;

(d) judging means for judging whether or not at least one new chord designated by said chord designating means is on a scale concerning said determined key stored in said memory means; and (e) key data control means for remaining said key data as it is when said judging means judges that said at least one new chord is on said scale, while said key data control means replacing said key data with new key data when said judging means judges that said at least one new chord is not on said scale, whereby a desirable key is automatically designated based on said key data to be controlled by said key data control means.

6. An automatic key designating apparatus according to any one of claims 1, 2 and 5 wherein said chord designating means is configured by a keyboard.

* * * * *